United States Patent [19]

Gieschen

[11] Patent Number: 4,478,373

[45] Date of Patent: Oct. 23, 1984

[54] CONICAL CRUSHER

[75] Inventor: John A. Gieschen, West Allis, Wis.

[73] Assignee: Rexnord Inc., Brookfield, Wis.

[21] Appl. No.: 196,509

[22] Filed: Oct. 14, 1980

[51] Int. Cl.[3] ..... B02C 2/04

[52] U.S. Cl. ..... 241/208; 241/285 R

[58] Field of Search ..... 241/290, 286, 285 R, 241/207-216

[56] References Cited

U.S. PATENT DOCUMENTS

| | | | |
|---|---|---|---|
| 2,409,391 | 10/1946 | Rumpel | 241/208 |
| 2,509,920 | 5/1950 | Gruender | 241/216 X |
| 3,235,190 | 2/1966 | Symons . | |
| 3,539,120 | 11/1970 | Szaj | 241/299 |
| 3,542,301 | 11/1970 | Trifonov | 241/207 |
| 3,570,774 | 3/1971 | Gasparac | 241/207 |
| 3,690,573 | 9/1972 | Kueneman et al. | 241/290 X |
| 3,759,453 | 9/1973 | Johnson | 241/207 |
| 3,797,759 | 3/1974 | Davis et al. | 241/30 |
| 3,797,760 | 3/1974 | Davis et al. | 241/30 |
| 3,804,342 | 4/1974 | Gasparac et al. | 241/37 |
| 3,843,068 | 10/1974 | Allen | 241/285 R |
| 3,887,143 | 6/1975 | Gilbert | 241/215 |
| 3,966,130 | 6/1976 | Doty | 241/285 R |
| 3,985,308 | 10/1976 | Davis | 241/290 |
| 4,168,036 | 9/1979 | Werginz | 241/285 R |
| 4,198,003 | 4/1980 | Polzin | 241/30 |

OTHER PUBLICATIONS

Pegsontelsmith Autocare, 1977.

*Primary Examiner*—Howard N. Goldberg
*Assistant Examiner*—Timothy V. Eley

[57] ABSTRACT

A crusher of the conical type has a spherical bearing arrangement for supporting the head assembly on a stationary shaft. Included are tramp release means for automatically opening the crusher throat when tramp material is encountered and for jacking open the throat under nonoperating conditions.

27 Claims, 14 Drawing Figures

CONICAL CRUSHER

BACKGROUND OF THE INVENTION

Generally, conical crushers have head assemblies which are caused to gyrate by an eccentric mechanism driven by various power sources. The head assemblies are covered by a wearing mantle which actually engages the material being crushed. Spaced from the head assembly and supported by the crusher frame is a bowl fitted with a liner which provides the opposing surface to the mantle for crushing the material.

The head which gyrates under the influence of the eccentric and moves relative to the frame must have a bearing surface which is positioned on some stationary bearing support. Various types of bearing supports have been employed in the conical crushers of the prior art. A problem which often results, however, is the undesired misalignment which can and does occur during extended operation of the crusher which can adversely affect further satisfactory operation of the crusher. It is thus a paramount object of the present invention to provide a crusher with a bearing support mechanism which minimizes misalignment over the life of the crusher.

Other objects and advantages will be evident from a reading of the detailed description including the beneficial use of a tramp release means for its customary function and additionally as a jacking device to clear the throat of the crusher when packed with material.

SUMMARY OF THE INVENTION

The conical cone crusher apparatus of the present invention is generally comprised of an annular shell and central hub to which an annular ring is mounted for vertical movement. The bowl and liner are mounted to the annular ring. A head assembly including its liner is mounted for movement via a bearing mechanism directly to a stationary shaft within the hub. Gyration of the head relative to the bowl assembly is provided by an eccentric mounted for movement about the stationary shaft.

A plurality of tramp release means bias the bowl and liner against a seat in position near the mantle and head assembly. The tramp release means is responsive to increased counter-forces which, when greater than its biasing force, causes the bowl to move upward relative to the head assembly, increasing the space therebetween and allowing the harder tramp material to pass through. The release means also provides a jacking mechanism which can be employed should, for example, the crusher throat be jammed with material and in need of being cleared. These functions along with a mechanical seat provides for positive positioning of the bowl after an operative sequence of the tramp release means.

DESCRIPTION OF THE PREFERRED EMBODIMENT

Crusher Structure

Figure 1:
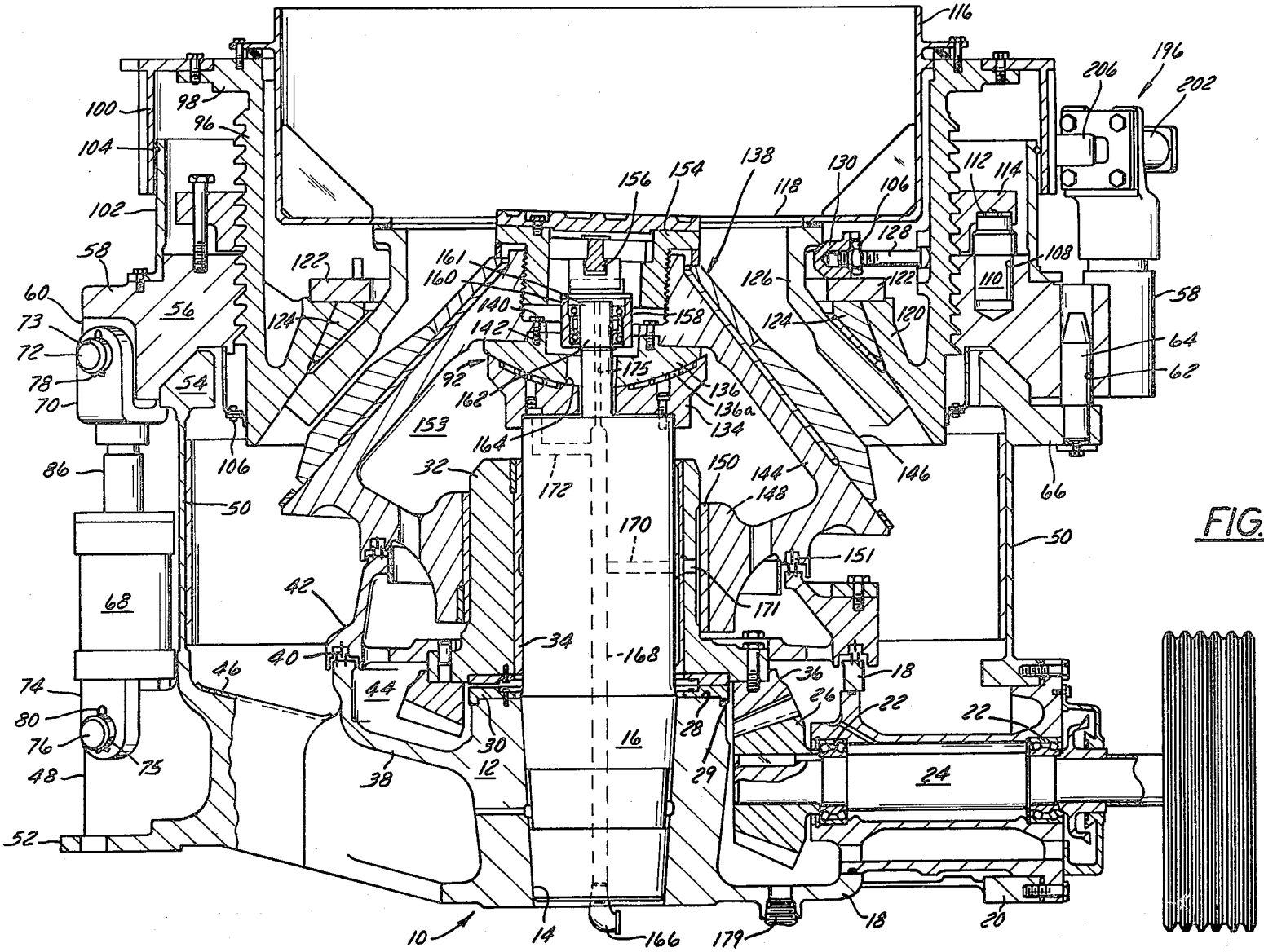
FIG. 1 is a side view, partly in section, of a crusher assembly of the present invention.

Referring to FIG. 1, a central hub 10 is formed from a cast steel member having a thick annular wall 12 forming an upwardly diverging vertical bore 14 adapted to receive a cylindrical support shaft 16. Extending outwardly from central hub 10 is a housing 18 which encloses drive pinion 26. Supported by housing 18 and an outer seat 20 is a countershaft box 21 which through bearings 22 is adapted to house shaft 24 with pinion 26.

Secured to the upper annular terminal surface 28 of wall 12 is an annular thrust bearing 30. An eccentric 32 via thrust bearing 30 is seated on horizontal surface 28 formed by the upper end 28 of hub 10 and is rotatable about shaft 16 via annular inner bushing 34. An annular gear 36 is bolted to eccentric 32 and meshes with pinion 26. A flange 38 positioned about hub 10 and integral therewith extends radially outward and curves upward, terminating adjacent the lower end of counterweight 32. Positioned between flange 38 and counterweight 42 is a seal 40 which may, for example, be of the labyrinth type as shown. Completion of gear well 44 at the point of engagement of pinion 26 is provided by flange 38 which comprises a seat for the lower section of seal 40.

Figure 2:
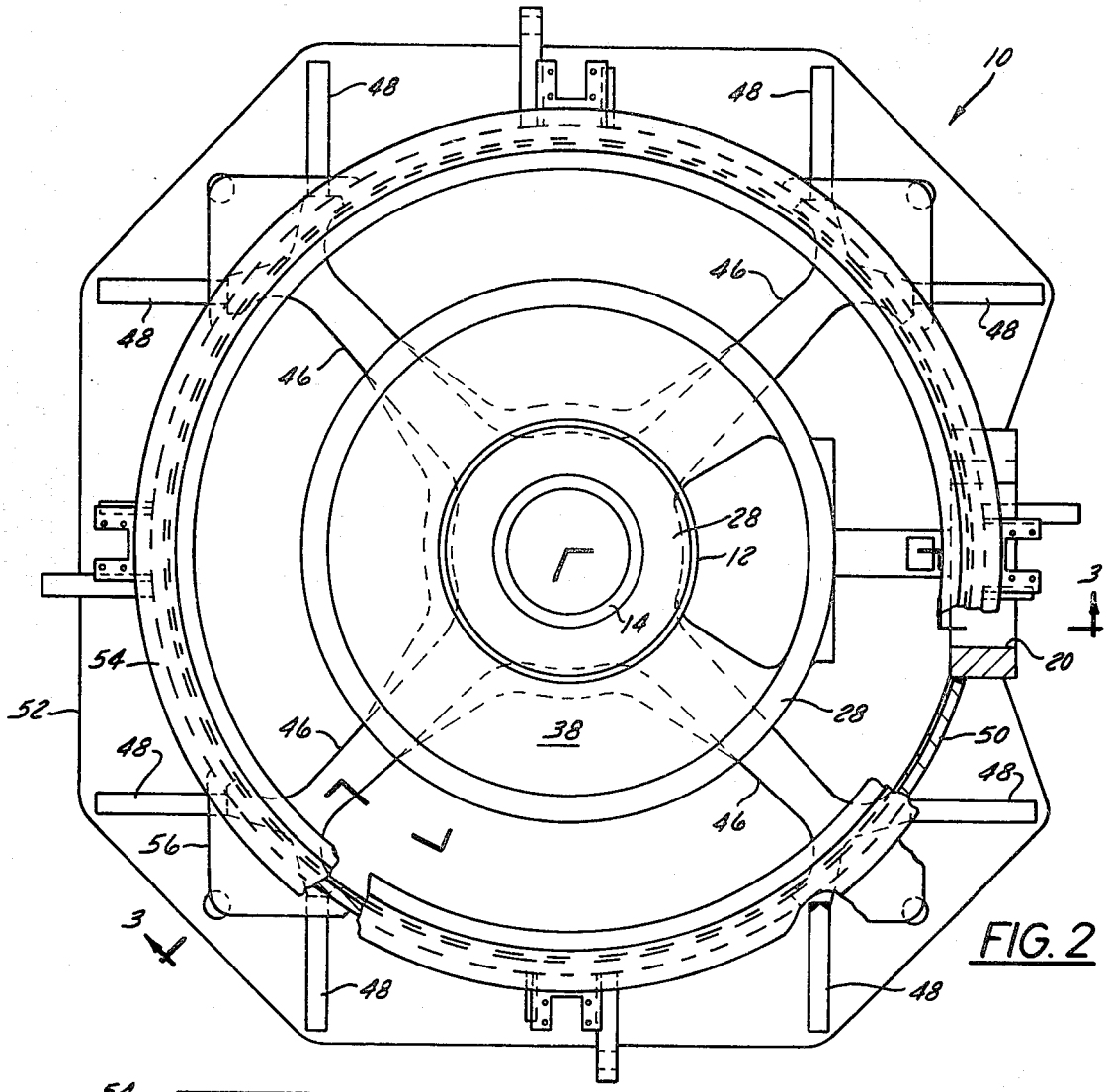
FIG. 2 is a plan view in section of the lower half of the crusher in FIG. 1 depicting the hub and extending arms.
Figure 3:
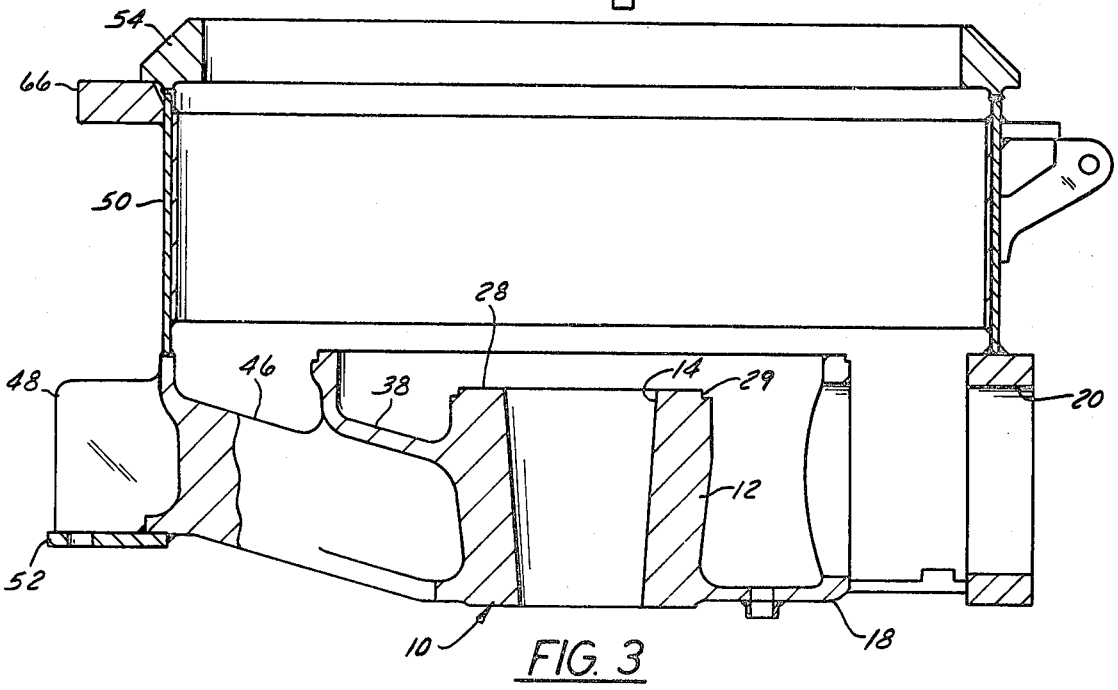
FIG. 3 is a side section view taken along lines 3—3 of FIG. 2.

Referring to FIGS. 2 and 3, central hub 10 is provided with a plurality of radially extending arms 46, the precise number being a matter of choice. As best seen in the plan view of FIG. 2, the outer end of each of the arms is bifurcated into a pair of vertical flanges or ribs 48, and a short vertical extension 49 is provided at the fork of the two ribs 48. A tubular main frame shell 50 is slotted and fabricated from sheet or plate steel to fit closely to and around countershaft box seat 20. Arms 46 and the extension 49 are welded along the interfacing portions of shell 50 and additionally to annular main frame flange 52. The upper portion of shell 50 terminates in an annular ring having a wedge section known as adjustment ring seat 54.

Figure 6:
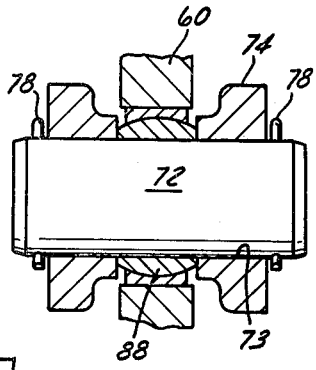
FIG. 6 is a sectional view taken along lines 6—6 of FIG. 4 showing the spherical bushing to which the clevis is attached.

Seat 54 normally supports an annularly shaped adjustment ring 56 positioned directly above. Adjustment ring 56 is provided with a plurality of horizontal flanges 58 with clevis ribs 60 vertically aligned with corresponding ribs 48. Located radially about adjustment ring 56 and between ribs 60 are guide bores 62 adapted to receive cylindrical guide pins 64 secured to horizontal flange 66 of shell 50. A hydraulically operated tramp release cylinder 68 is positioned between each rib 48 and rib 60, respectively, by a clevis 70 and pin 72 at the top and clevis 74 and pin 76 at the bottom. Cotter pins 78, 80 secure each pin 72, 76 within bores 73, 75 of each respective clevis 70, 74. As may be seen in the sectional view of FIG. 6, each clevis pin 72 rides on a spherical bushing 88 supported in a spherical bearing 89. While not shown, the same is true for pins 76 also. This permits tangential and radial misalignment of the cylinder 68 associated with a one-sided lifting of ring 56.

Figure 5:
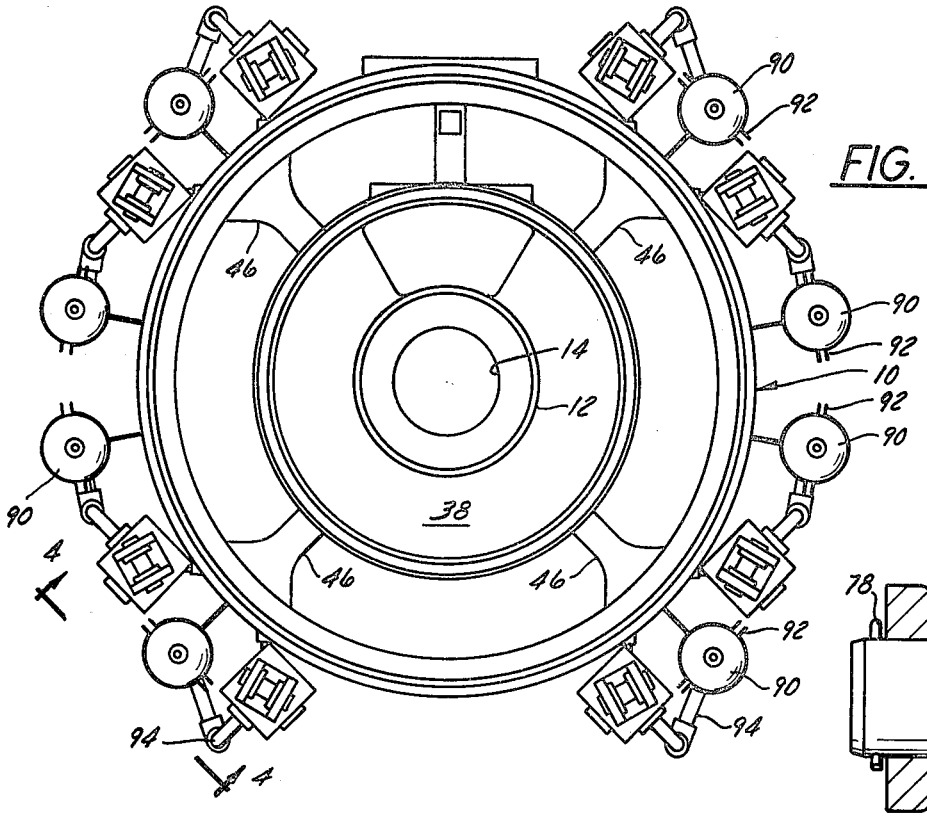
FIG. 5 is a plan view of a crusher of the present invention (with much detail omitted) depicting the tramp release cylinders.
Figure 4:
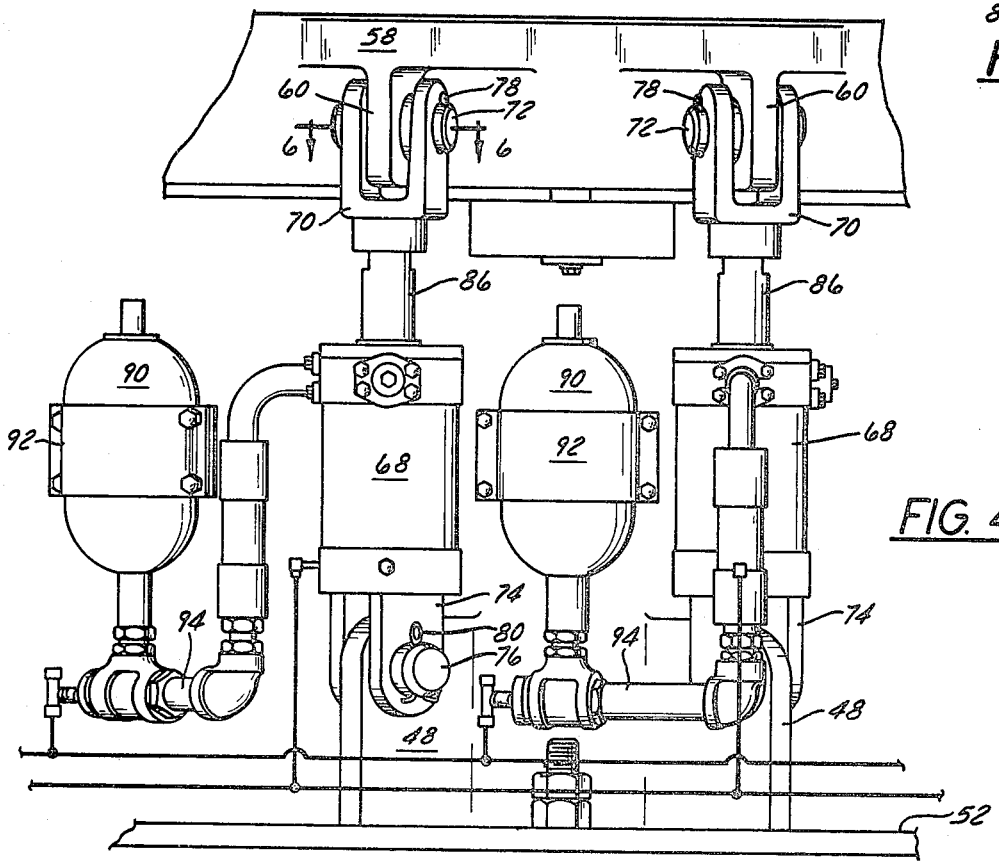
FIG. 4 is a perspective side view of a portion of a crusher of the present invention taken along lines 4—4 of FIG. 5, showing the tramp release cylinders, accumulator tanks, and assorted piping.
Figure 7:
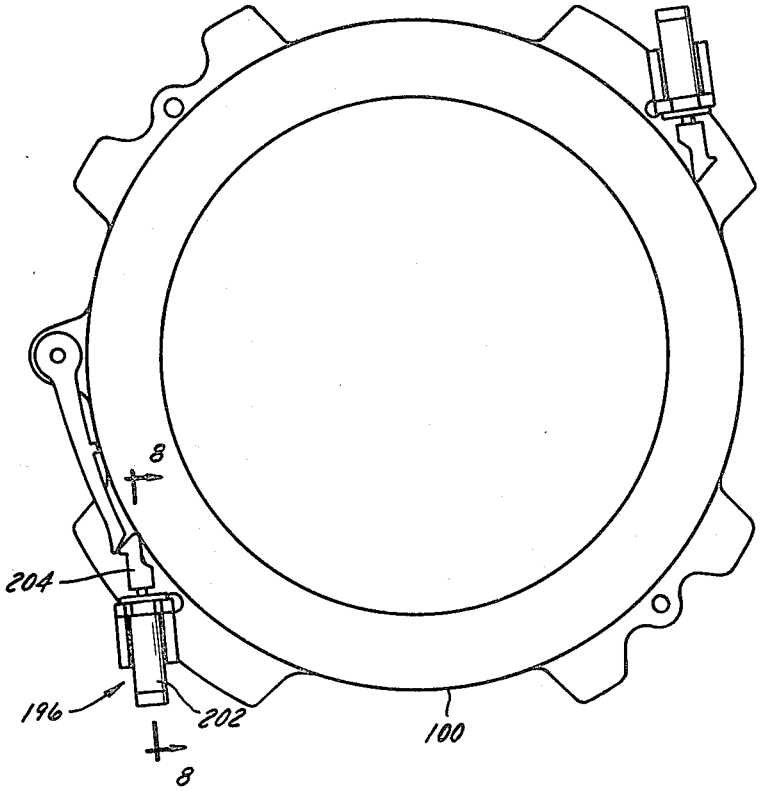
FIG. 7 is a simplified plan view of a crusher of the present invention illustrating the ram assembly for rotating the bowl.

While the cylinder 68 in FIG. 1 is shown directly fastened to rib 48 and piston 86 to rib 60, the same function could be equally accomplished by reversing the manner of fastening. As best seen in FIGS. 4 and 5, each tramp release cylinder 68 has an accumulator tank 90 associated with it. Tanks 90 are bolted into clamp brackets 92 which are welded to main frame 50. Fluid communication is made through piping 94 connecting the lower end of tank 90 to the upper portion of cylinder 68. Thus, when tramp release cylinder 68 is overcome as described in the section relating to the hydraulic control circuit, adjusting ring 56 may move vertically upward as permitted by the guiding cooperation between pins 64 and bores 62, returning to the normal seated position when the tramp material has been discharged.

While FIGS. 4 and 5 show a tank 90 with each cylinder 68, any appropriate combinations may be used. For example, in many instances it is preferable to have one tank 90 associated with two cylinders.

It may be seen from FIG. 1 that the inner annular surface of adjusting ring 56 is helically threaded to receive a complementary threaded outer annular surface of the crusher bowl 96. Rotation of bowl 96 thus adjusts the relative position thereof with respect to ring 56 and changes the setting of the crushing members. The upper extension of bowl 96 terminates in a horizontal flange 98 to which is bolted a downward extending annular adjustment cap ring 100. To prevent the accumulation of material between the meshing threads of ring 56 and 96, an annular dust shell 102 is bolted to ring 56 so that shell 102 is closely circumscribed by ring 100 in a telescoping relationship. Seal 104 is provided to completely enclose the volume. A second seal member 106 is secured to the under surface of adjusting ring 56 and contacts the lower extension of bowl 96 thus preventing upward entry of material into the area between the threads.

Ring 56 is also provided with a plurality of bores 108 located inside the perimeter circumscribed by shell 102. Seated within each bore 108 is a spring loaded cylinder 110 having a piston 112 end contacting annular clamping ring 114 threadedly engaged around bowl 96, the precise number being a matter of choice. Cylinder 110 and piston 112 normally biases ring 56 and bowl 96 into a tightly threaded engagement so as to prevent movement, both axially and radially, of bowl 96 when the crusher assembly is in operation. The cylinders 110 can be unloaded by hydraulic pressure to remove the bias, either partially or completely, when adjustment is desired.

Bolted at various spaced positions along the top surface of flange 98 is material feed hopper 116. Hopper 116 extends into the opening enclosed by bowl 96 and is provided with a central opening 118 for egress of material into the crusher. Bowl 96 additionally has a converging frustoconical extension 120 which converges upward from the lower end thereof. Welded to the top surface of extension 120 are adapters 122 and a plurality of wedges 124 filling the space between upper liner 126 and extension 120. Bolts 128 are inserted into wedges 130 which are forced between adapters 122 and liner 126. Rotation of nut 132 abutting wedge 124 provides a means of locking liner 126 to bowl 96 tightly in place. Liner 126 is commonly fabricated from manganese steel. A more detailed explanation of a suitable means for securing a liner to its bowl may be found in commonly assigned U.S. Pat. No. 3,539,120.

Cylindrical support shaft 16 extends above eccentric 32 and supports socket bearing or spherical seat 134. Seated against socket bearing 134 is spherical upper bearing 136 which supports the entire head assembly 138. Bearing 136 is secured to the under surface of a horizontally positioned annular flange 140 by bolts 142. Flange 140 is integral with head member 144 having a conical configuration about which is positioned a mantle 146. Extending inwardly of head member 144, a follower 148 having a head bushing 150 is disposed around and engaging the outer surface of eccentric 32. A seal 151 is positioned between follower 148 and the upper extension of counterweight 42.

As may be seen in FIG. 1, the shape of counterweight 42 is designed to compensate for the mass eccentricity of eccentric 32 so that the assembly of eccentric 32 and counterweight 42 is dynamically balanced about its center of rotation. The lower section of seal 151 is concentric with the eccentric axis of the cylindrical outer surface of eccentric 32 so it meshes with the upper section at all times during head gyrations. Thus, the parts mentioned above together with seal 40 and the close fit of various parts ensure that the entire internal cavity shown generally as 153 is virtually a dust free environment in which the gear 36 and socket bearing 134 may perform unimpeded from accumulation of dust.

Engaged to the upper end of head member 144 is a retrograde cap 154 supporting one element of a coupling means 156 coupled to a one-way clutch 158. The outer race 160 of the clutch 158 is linked through the coupling 156 to cap 154 while the inner race 161 is fixed to an extension 162 of shaft 16 extending through central opening 164 in bearings 134 and 136. The purpose of clutch 158 is to prevent rotation of mantle 146 in the direction of rotation of the eccentric 32 when the crusher is running without feed. If the clutch were not provided, the head would have a tendency to accelerate to full eccentric speed dependent on the frictional resistance and it would become difficult to introduce feed into the cavity as well as to retain it. On the other hand, while crushing, the one-way clutch permits slow backward rotation due to a peripheral rolling action between the mantle and bowl liner. This reduces liner wear.

Lubrication is supplied to the crusher assembly through an oil inlet 166 which communicates with main oil passage 168 formed in shaft 16. Lubricant is provided to eccentric 32 and eccentric follower 148 via passage 170 which extends from passage 168 and communicates with passage 171 through the wall of the eccentric. Additionally lubricant penetrates into the space between bearings 134 and 136 through passage 172. Additionally, lubricant flows from passages 168 and 175 to lubricate the coupling 156 and clutch 158. A drain 179 is positioned in housing 18 to take away oil draining from gear 36, pinion 26, and the eccentric 32 above.

SPHERICAL BEARING

It is important to more fully understand one of the paramount advantages of fastening spherical bearing seat or socket 134 directly to stationary shaft 16 as set forth in this application. To do so, however, necessitates a review of various crusher assemblies of the prior art in order that a comparison can effectively be made.

Figure 11C:
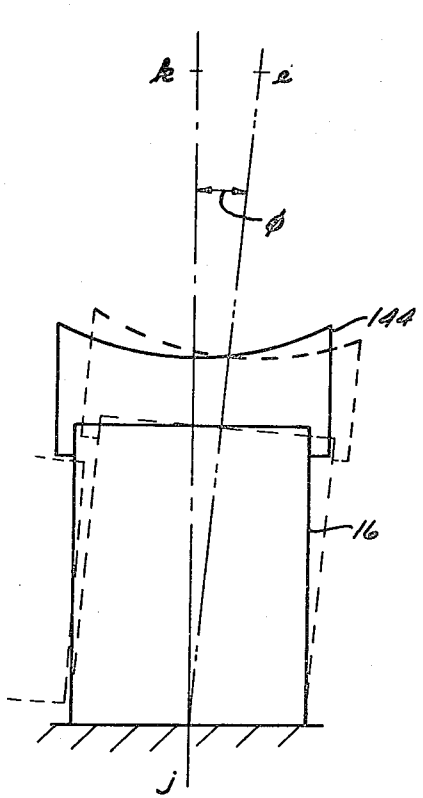
FIG. 11*c* is a schematic of the bearing arrangement as set forth in the present invention.
Figure 11B:
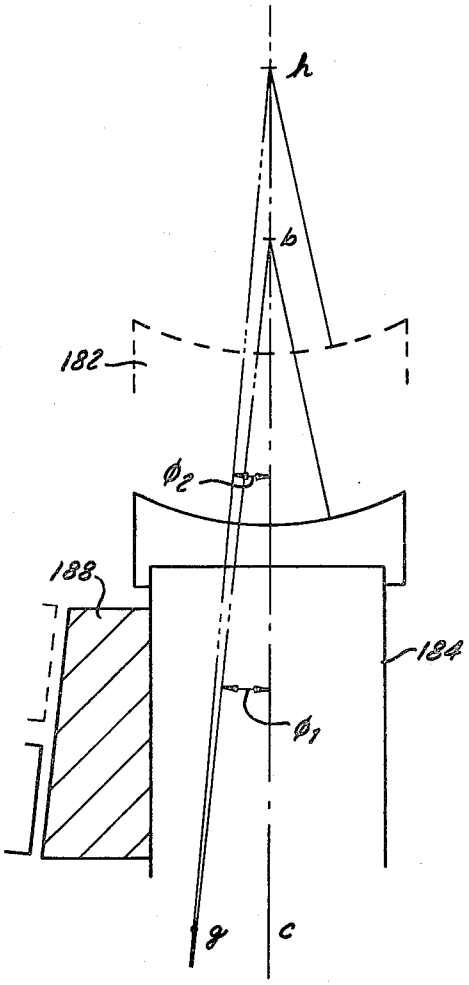
FIG. 11b PRIOR ART
FIG. 11*b* is a schematic of a prior art arrangement where the lower bearing surface is mounted on a moveable piston.
Figure 11A:
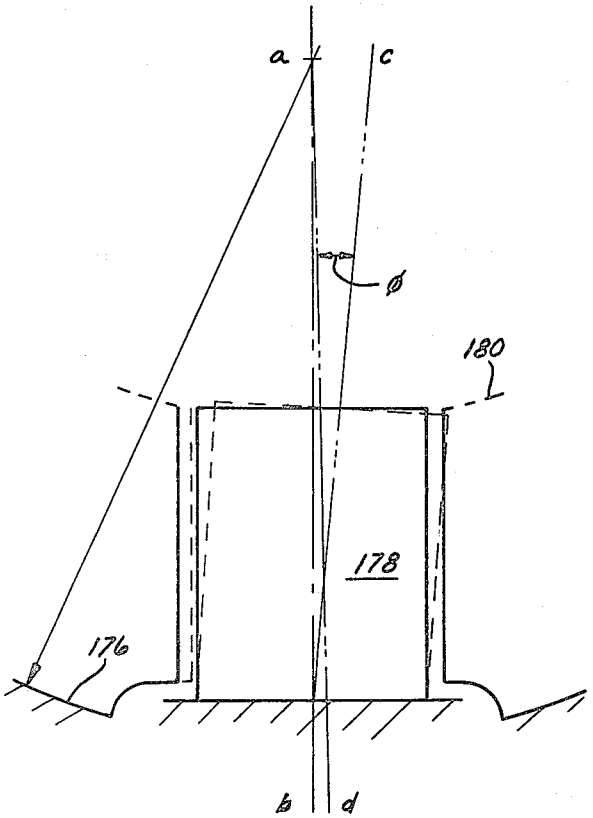
FIG. 11a PRIOR ART
FIG. 11*a* is a schematic of a prior art arrangement for bearing placement for the head assembly.

Reference is now made to FIG. 11*a* which represents diagramatically a crusher assembly where spherical bearing seat 176 is secured directly to the frame assembly. As can be noted, line a–b is the centerline of both shaft 178 and head assembly 180 before being placed under load.

The loads applied laterally to the shaft when the crusher cavity is supplied with feed are, ideally, distributed inwardly and provide lateral radial pressure between the inner bearing and the shaft resulting from the action of the eccentric. In a like manner, the force of the eccentric is distributed outwardly and provides lateral radial pressure on the head of the head assembly. For the sake of simplicity, only the head and shafts are shown in the various FIGS. a–c. Similarly, the spatial relationships between the head and shaft are described without inclusion of the eccentric in FIGS. 11*a* and 11*c* and without the surrounding bearing sleeves at all.

On this basis, line b–c represents the centerline of shaft 178 under load, and line a–d is the center line of head assembly 180 under load and thus represents the deflected position. Because head assembly 180 is positioned on spherical bearing seat 176, the center line a–d is forced to pass through a point which is the center of curvature of seat 176. The angle $\phi$ representing the angle of misalignment can be significant and deleteriously effect long term operation of the crusher because of the shaft deflection and angular head movement which causes non-uniform load distribution on the bearing.

In still other crusher assemblies as shown diagramatically in FIG. 11*b* the spherical bearing seat 182 has been secured directly to a moveable piston 184. The piston 184 is moveable to compensate for wear of the liners after extended operation by maintaining a constant gap between the head and bowl liners. The advantage of the structure set forth in FIG. 11*b* over the structure in FIG. 11*a* is that bearing seat 182 deflects with pistion 184. Thus, the center line of the head 188 and piston 184 under deflection are very closely aligned under load, making the angle of misalignment small prior to liner wear.

The disadvantage results when it is necessary to displace pistion 184 upward to compensate for wear. As shown in FIG. 11*b*, e–f is the centerline of piston 184 while g–f is the center line of both head assembly 186 (not shown in FIG. 11*b*) and eccentric 188. Point f is the center of curvature of seat 182 before upward displacement of piston 184. As is evident, point h becomes the new center of seat after liner wear or other adjustments resulting in respositioning of seat 182 as shown by the dashed lines. Now the center line of head 186 is g–h. Consequently, the misalignment of the bearing is proportional to the upward displacement of piston 184. Similar reasoning can be applied for downward displacement of the piston corresponding to a large gap or new wear material condition.

Additionally, there is a further disadvantage which compounds the bearing alignment. Because it is necessary to have sufficient clearance between piston 184 and surrounding bearing surface to allow for unimpeded vertical displacement, the lateral loads on piston 184 cause an unimpeded repositioning of piston 184 to a cocked position contacting the cylinder wall. This can perhaps be illustrated by FIG. 11*c* which shows the cocking of the stationary shaft of the present invention along line j–l. The problem which arises, however, is that with the moveable piston arrangement of FIG. 11*b* the effect of cocking and upward displacement of piston 184 can and does occur simultaneously, resulting in an undesirable and unpredictable misalignment condition, affecting bearing operation.

FIG. 11*c* diagramatically represents the misalignment which occurs in the apparatus of the instant application. It attains the advantage of the apparatus described in relationship to FIG. 11*b* without the attendant disadvantages. Since shaft 16 is stationary and adjustment for liner wear is accomplished by movement of the bowl 96 in adjustment ring 56 without affecting head 144 on shaft 16 as described in detail elsewhere in this description, there is no vertical displacement of the spherical bearing seat 134 nor is there a lateral displacement due to piston clearances to cause bearing misalignment. The spherical bearing seat 134 is mounted to the top of shaft 16 so that deflection under load while causing an angular displacement of the shaft centerline j–l, also causes a movement of the spherical bearing center from k to l. The head bearing surface is thus displaced angularly in the same direction and in nearly the same amount as the shaft surface, resulting in a greatly reduced angle of misalignment throughout operation of the crusher.

RAM ASSEMBLY

Figure 8:
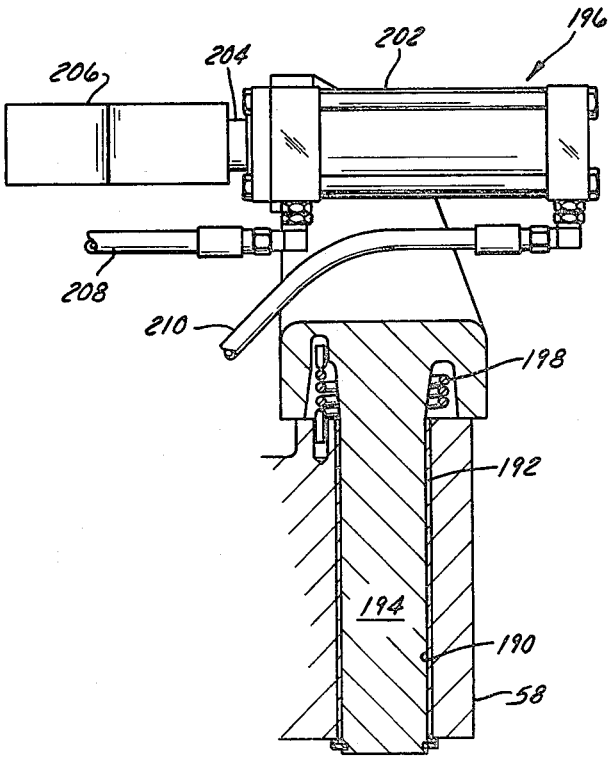
FIG. 8 is a view, partly in section, taken along lines 8—8 of FIG. 7.
Figure 10:
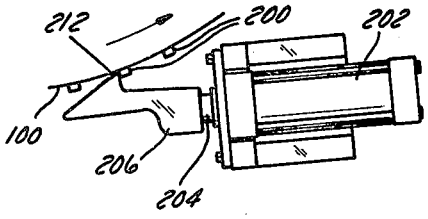
FIG. 10 is a view of the ram assembly when moving the adjustment cap ring clock-wise.
Figure 9:
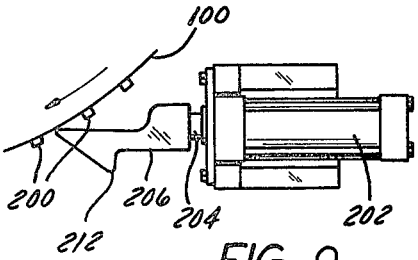
FIG. 9 is a view of the ram assembly when moving the adjustment cap ring counter-clockwise.

Referring now to FIGS. 7–10, and particularly FIG. 8, it may be seen that flanges 58 are provided with bores 190 and bearing surfaces 192 to receive rods 194 serving as a support mount for ram assemblies 196. Rods 194 are rotatable within bores 190, but are spring biased through springs 198 to a particular position therein. Adjustment cap ring 100 has a plurality of vertically positioned ribs 200 spaced along the outer surface thereof adjacent assembly 196. Although not essential, it is preferred to have two ram assemblies 196 located 180° apart. Each ram assembly 196 comprises a hydraulic cylinder 202 and a piston 204 which terminates in a wedge-shaped fork member 206. Fluid pressure is supplied to the cylinder 202 through one of two supply lines 208, 210. When assembly 196 is actuated in a manner described more specifically herein in reference to FIG. 9, fork 206 is extended and contacts one of the ribs 200, causing cap ring 100, and consequently the entire bowl 96, to rotate clockwise as the ram is extended. As the ram retracts, the fork 206 ratchets across the cap ring 100 and engages the next adjacent rib 200. When counter-clockwise rotation of cap 100 is desired, the fork 206 is rotated 180° on its own axis relative its cylinder to the position shown in FIG. 10. In this position, the fork 206 engages a rib 200 on the retracting stroke moving the cap ring 100 counter-clockwise and its ratchets on the extension stroke.

Because, as stated earlier in this description, bowl 96 and ring 56 are provided with complementary threads, rotation of cap ring 100 permits the distance between liner 126 and mantle 146 to be ordinarily set under static conditions, i.e. the state in which the crusher is not operating. The distance itself is determined by the desired crushing action, the size of the material being fed into the crusher cavity by feed hopper, and the desired size of the crushed material. As wear occurs along the cavity profile lines, compensatory setting of the crusher cavity dimensions is also necessary. It is, however, possible to compensate for crusher wear during operation, thus preventing the need for shutting down the crusher. Commonly assigned U.S. Pat. Nos. 3,797,759 and 3,797,760 explain this advantageous feature in detail. Briefly, it is accomplished by partially unclamping bowl 96 so that bowl 96 may be rotated by the ram assemblies and then immediately clamped again at the conclusion of the ram stroke.

HYDRAULIC CONTROL CIRCUIT AND OPERATION OF CRUSHER

Figure 12:
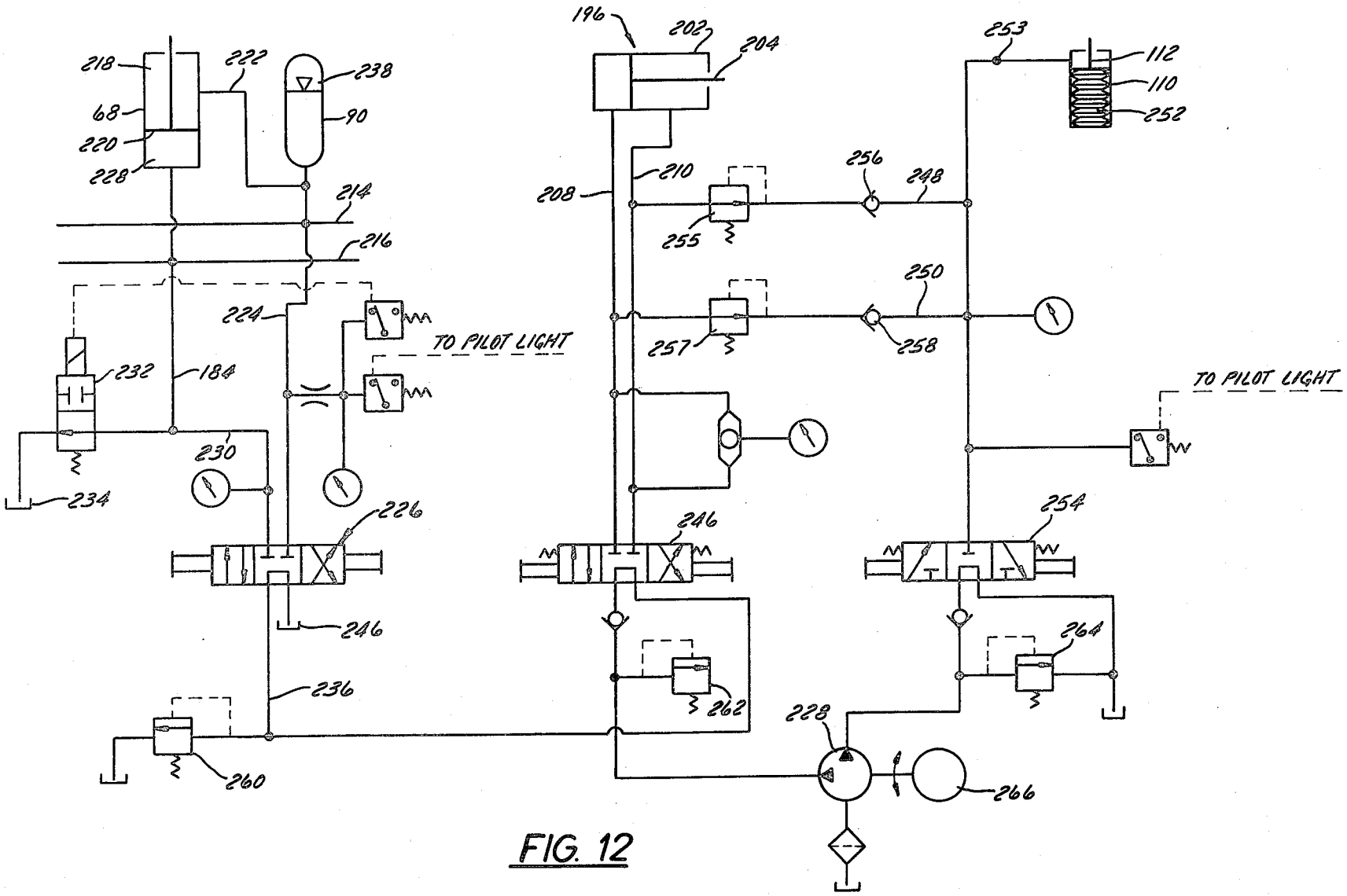
FIG. 12 is a hydraulic schematic of the system employed in a crusher of the present invention.

Referring now to FIG. 12, the specifics of the hydraulic control circuit may be viewed. The circuit as shown is employed with the tramp release cylinder 68, the ram apparatus 196, and the clamping cylinders 110. It is evident that separate circuitry may be employed as desired, however it is economical to use a single integrated hydraulic circuit.

The portion of the circuit pertaining to control of tramp release cylinder 68 is seen in the left hand portion of FIG. 12. To maintain the simplicity and clarity of the drawing and description, only a single cylinder 68 and its accompanying accumulator tank 90 are shown. Other cylinders and tanks, as many as appropriate, may be included in the circuit, connected in parallel as indicated by lines 214 ad 216. Variuos numbers of accumulators may be employed and they may be connected to line 214 without affecting their function. A symmetrical grouping of cylinders and accumulator tank(s) is preferred to facilitate connections of equal lengths of piping. The upper chamber 218 of cylinder 68 is depicted above piston 220 and communicates via line 222 with the lower chamber of accumulator tank 90 where both connect through line 224 to 4-way, 3-position valve 226. Lower chamber 228 is vented by line 231 to a spring loaded, solenoid valve 232 normally biased in the open position to reservoir 234. Line 230 connects line 231 to valve 226, which in turn communicates with a fluid pressure source 268 via line 236.

Accumulator tank 90 may be various designs, but is preferably designed as a steel tnk with a gas impervious bladder 238 (seen in FIG. 12 only) separating the upper and lower volumes of accumulator 90. Initially, prior to introducing the hydraulic fluid media, the accumulator is charged through a valve (not shown) with a gas until the gas behind the bladder completely fills the entire volume. The fluid media is then introduced, compressing the gas media until a desired pressure balance is reached.

When valve 226 is actuated to the right from its normally centered position illustrated in FIG. 12, it couples the line 236 from the fluid pressure source 268 directly to lower chamber 228 of the tramp cylinder. Simultaneously, upper chamber 218 and the accumulator 90 are vented to reservoir 246. The pressure in lower chamber 228 causes piston 220 to be driven vertically upward to the limit permitted by cylinder design and increases the cavity space in the crusher which is necessary when it is desired to clear material from the crusher throat. Valve 232 is closed during the clearing operation. To charge the upper chamber 218 and accumulator 90, valve 226 is actuated to the left thereby again venting lower chamber 228 and connecting line 224 to the line 236 connected to the pressure source 268 until the desired pressure is reached. Thus, the cavity space is restored to its appropriated operating volume.

When the crusher is in operation, piston head 220 in cylinder 68 is normally in the position shown, maintained in such position by the hydralic pressure in the upper chamber 218. When the crusher encouters tramp material, the upward mechanical force exerted on the piston 220 is greater than the downward hydraulic force, driving the fluid out of chamber 218 and into accumulator 90 further compressing the gas in the upper chamber. As now understood from FIG. 1, the set hydraulic pressure within cylinder 68 and escape route of the fluid allows piston 220 to move upward along with ring 56 and bowl 96. The distance between liner 126 and mantle 146 is increased, permitting passage of the tramp material. Once the tramp material passes through and no longer exerts an upward force on piston head 220, the compressed volume above the membrane 238 expands, driving piston head 220 downward. Thus, adjustment ring 56 and bowl 96 descend until ring 56 again abuts seat 54. A desirable feature of the engagement of ring 56 against a stationary member during normal operations is that a positive reference point is always available. If ring 56 via piston head 220 were designed to float on hydrulic pressure instead of seating on the seat 54, some disadvantages would be encountered due to the inevitable dimensional changes that occur over the life of cylinder 68 and accumulator 90. The changes would cause a variance in the distance between liners for a particular hydraulic charge in cylinder 68 and accumulator 90, even if ther were no liner wear or the liners had been replaced.

Valve 232 serves a needed function as it continously vents lower chamber 228 of cylinder 68 to reservoir 234 during operation of the crusher. In the event residual hydraulic fluid is present in lower chamber 228 from other operations, or there is leakage from the upper end, the fluid is provided a route to escape from the cylinder. Without this escape route, the entire cylinder 68 could suffer from hydraulic shock if piston head 220 were to impact against the fluid, perhaps resulting in structural damage.

A distinct advantage of the present structure is that the use of tramp release cylinders 68 not only provide for the passage of hard material which might otherwise damage mantle 146, head member 144, or other crusher parts, but act also as hydraulic jacks for separating mantle 146 and liner 126 to permit occasional clearing of the crusher of plugged or stuck material. While crushers of the prior art are capable of both releasing material under loaded conditions and clearing plugged material, the apparatus of the present invention uses a single means to accomplish both functions. Of course, in simpler crushes where the dual function is not necessary, the customary tramp release springs could be employed, eliminating the use of the release also operating as a hydraulic jack.

In FIG. 12, the middle circuitry associated with valve 246 controls ram assembly 196 and essentially comprises, as discussed before, hydraulic cylinder 202, a piston rod connected to piston 204 (connected to the ram fork 206), and spring loaded 4-way, 3-position valve 246. When valve 246 is actuated right, piston 204

(and fork 206) are driven outwardly. Actuating valve 246 to the left causes piston 204 to be retracted. Thus, as can be seen by referring again to FIGS. 9 and 10, each right and left actuation of valve 246 causes rotation of cap ring 100 an angular distance which depends mainly on the stroke of piston 204 and in a direction determined by position of fork 206.

Because the free rotation of bowl 96 during adjustment conditions dictates that the clamping ring 114 not be actuated to tighten bowl 96 against ring 114, the ram circuit is tied by lines 248 and 250 into the hydraulic circuit (seen on the right side of FIG. 12) for the clamping cylinder 110. When pressure is applied in line 253, piston 112 of clamping cylinder 110 is driven downward against the upward biasing action of disc springs 252. The clamping ring 114 and therefore adjusting ring 56 becomes loosely intermeshed with bowl 96. When adjusting the crusher, valve 246 is moved to the right and pressure from line 208 is communicated through valve 257 and line 250 to line 253. Valve 257 is adjusted to limit the pressure in line 250 to a predetermined maximum which maintains thread contact while it provides only a partial loosening for adjustment while crushing. In a similar way, moving valve 246 to the left pressurizes line 210 which communicates through valve 255 and line 248 to line 253. This provides a partial loosening while cylinder 202 is retracting. At the end of any adjustment cycle, the retained pressure in line 253 is released by moving valve 254 to the left.

Additionally, complete loosening of clamping ring 56 may be accomplished via actuating valve 254 to the right. Actuating valve 254 permits return of piston 112 to its normal biased position. Check valves 256, 258 by isolating ram assembly circuit from the bowl tightening circuit, thereby preventing any effect on the ram assembly circuit.

It should also be noted that safety releif valves 260, 262, 264 are provided for each circuit. A single rotary actuator motor 266 may be provided as shown with a divided outlet 268, a majority of which is directed toward the tramp release cylinders and ram assemblies.

I claim:

1. An apparatus for crushing materials, comprising:

(a) a frame structure including a hub member having a vertical bore;

(b) a stationary support member having a central longitudinal axis, and having an upper portion and a lower portion, said lower portion being positioned within said bore and secured to said hub;

(c) a cylindrical eccentric mounted around said stationary support member for eccentric rotation therearound, said eccentric having an axis which intersects said longitudinal axis;

(d) means for rotating said eccentric about said support member;

(e) a head assembly having a cylindrical eccentric follower mounted on said eccentric for eccentric rotational movement about said support member, and including a lower crusher surface, and an upper spherical bearing member fixed to the underside of said head assembly;

(f) a bowl assembly mounted for adjustable movement relative to said frame, said bowl assembly having an upper crusher surface spaced an adjustable predetermined distance from said lower surface under static conditions; and (g) a spherical bearing seat supported by rigidly fixed to said upper portion of said support member, and holding and supporting said upper spherical bearing member, said spherical bearing seat having a center of curvature which substantially coincides with said intersection of said eccentric axis and said longitudinal axis.

2. The apparatus of claim 1, further comprising a plurality of release means for maintaining said predetermined distance of said upper crusher surface from said lower surface under normal loaded conditions, for allowing said upper crusher surface to move upward under abnormal conditions, and for forcibly lifting said bowl assembly upwardly away from said head assembly for clearing.

3. The apparatus of claim 2 in which said release means comprise a plurality of double acting hydraulic assemblies, each including a piston axially movable in an enclosing cylinder, one end of each assembly is mechanically coupled to said upper crusher surface, and the other end is mechanically coupled to said frame; said release means allowing upward movement of said upper crusher surface in response to external pressures above a predetermined level caused by the encounter of tramp material between said upper and lower crusher surfaces, said release means returning said upper crusher surface to its initial position when the external pressures decrease to the predetemined level.

4. The apparatus of claim 3, further comprising a pluraity of radially extending arms having outer ends and having inner ends connected to said hub, said other ends of said hydrualic assemblies being connected, one each, to the outer ends of said arms.

5. The apparatus of claim 1, further comprising lubrication passages in said support member and said eccentric communicating directly between a source of pressurized lubricant and a bearing interface between said bearing seat and said upper spherical bearing member and to bearing interfaces between said eccentric and said support member and said head assembly for supplying lubricant to said bearing interfaces.

6. The apparatus of claim 1, further comprising bowl position adjusting means mounted on said frame for adjusting the vertical position of said bowl relative to said stationary support member, and thereby adjusting the static distance between said upper and lower crushing surfaces.

7. The apparatus of claim 6 wherein said bowl position adjustment means includes a ram having a cylinder and a piston axially movable within said cylinder, said ram being mounted on said frame with the axis of said ram oriented at a secant to said bowl, and means on said ram for selectively pushing against said bowl to rotate said bowl on the extend stroke of said ram, and for pulling on said bowl to rotate said bowl in the other direction on the retract stroke of said ram.

8. A crusher of the conical type having a stationary lower frame assembly, a vertically movable upper frame assembly biased toward said lower frame assembly, a head assembly including a crusher head mounted on a support means for gyratory motion relative to said frame assemblies, an adjustable bowl mounted to said upper frame assembly for vertical movement relative to said frame assemblies and head assembly and eccentric means for imparting gyratory motion to said head, and a drive means for driving said eccentric means, said crusher characterized by release means including biasing means and lifting means connected to said lower and upper frames for releasably biasing said upper frame into an abutting relationship with said lower frame and responsive to a first signal for deactivating said biasing means and activating said lifting means for lifting said upper frame away from said lower frame to permit the clearing of jammed material, and responsive to a second signal for activating said biasing means and deactivating said lifting means; said release means comprising a plurality of double acting hydraulic cylinders and pistons, said cylinders connected to one of said frame assemblies and said pistons connected to the other of said frame assemblies, one end of said cylinders being pressurized in a normally operating crushing mode to exert a hydraulic biasing force to hold said frame assemblies together in abutting relationship, and further including at least one normally pressurized accumulator in fluid communication with said one end of one of said cylinders to receive fluid displaced from said one cylinder when tramp material passes through the crushing cavity between said head and said bowl.

9. The crusher of claim 8 in which said piston is connected directly to the upper frame assembly and is biased downwardly by hydraulic pressure within said cylinder above said piston.

10. The crusher of claim 8 in which said one end of said cylinder communicates with said accumulator and, through a selectively movable valve, selectively with a hydraulic fluid reservoir and a hydraulic pressure source to vent said one end in a clearing mode for vertical separation of said frame assemblies, and to pressurize said one end in a normal crushing mode to bias said frame assemblies into abutting relationship, and the other end of said cylinder is selectively connected through said valve to said hydraulic pressure source in said clearing mode to lift said upper frame assembly away from said lower frame assembly, and to said reservoir in said normal crushing mode.

11. The crusher of claim 10 in which said valve means comprises a 4-way , 3-position valve for selectively connecting the two ends of said cylinder with said source of hydraulic fluid pressure and said reservoir.

12. The crusher of claim 8, wherein said lower frame assembly further comprises a central hub and a plurality of arms having inner and outer ends, said arms attached at their inner ends to, and extending radially from, said hub, said arms bifurcating at their outer ends and having means on the bifurcated outer ends for attachment thereto of one end of said release means.

13. The crusher of claim 8, wherein said lower frame assembly includes an annular shell having an upper portion which terminates in a ring seat having a beveled upper surface; said upper frame assembly includes a ring having a beveled lower surface corresponding to said ring seat upper beveled surface, said biasing means normally holding said ring against said seat with said beveled surfaces in contact with each other.

14. A crusher frame, comprising:

(a) a hub member having a vertical bore for receiving a stationary crusher apparatus support member and an annular, substantially horizontal surface about said bore for rotatably supporting an eccentric;

(b) a horizontally positioned base flange;

(c) a plurality of arms integral with and extending radially outwardly from said hub, each of said arms bifurcating into a pair of diverging vertical flanges secured to said base flange;

(d) an annular shell fabricated from sheet steel and positioned in a welded, abutting relationship to said base flange between said arms and to said extension of said arms;

(e) an annular ring yieldably secured along its lower periphery in an abutting relationship to the upper periphery of said annular shell;

(f) an annular member movable attached to the internal surface of said annular ring for vertical movement relative to said annular ring; and (g) yielding means fixedly secured to each of said vertical flanges and yieldably secured to said annular ring for biasing said annular ring to said annular shell.

15. A crusher frame in accordance with claim 14 in which the lower periphery of said annular ring and the upper periphery of said annular shell have complimentary sloped abutting surfaces.

16. A crusher frame in accordance with claim 14 in which said hub member has an integral extension intermediate the upper and lower ends of said hub member which integral extension, with said hub member, forms part of an enclosure configured to receive a gear secured to said eccentric.

17. A crusher of the conical type having a stationary lower frame assembly, a vertically movable upper frame assembly biased toward said lower frame assembly, a head assembly including a crusher head mounted on a support means for gyratory motion relative to said frame assemblies, an adjustable bowl having an annular surface with spaced abutments and mounted to said upper frame assembly for vertical movement relative to said frame assemblies and head assembly by virtue of interfacing, helically threaded surfaces of said upper frame and bowl, an eccentric for imparting gyratory motion to said head, and a drive means for driving said eccentric, said crusher characterized by having a bowl adjusting double acting ram assembly mounted on one of said frame assemblies, said ram assembly having a cylinder and, within said cylinder, an axially reciprocating piston, said cylinder having fluid connectors for delivering pressurized fluid selectively to either side of said piston, a fork connected to said piston having two engaging surfaces for selective engagement with opposite sides of said abutments, said fork having first and second positions in which said ram assembly rotates said bowl in one direction on the extension stroke of said piston when said fork is in said first position, and in the other direction on the retraction stroke of said piston when said fork is in said second position, thereby imparting vertical movement to said bowl.

18. The crusher of claim 17 in which one of said fork engaging surfaces in said first position contacts one side of said spaced abutments during said extension stroke of said piston, and the other of said fork engaging surfaces in said second position contacts the other side of said spaced abutments during said retraction stroke of said piston.

19. An apparatus for crushing materials, comprising:

(a) a frame structure including a base, an annular shell supported by said base, a central hub with a central bore, and a plurality of arms integral with and extending radially out from said hub and terminating at said base, said annular shell having an upper portion which terminates in a ring seat;

(b) an annular ring mounted for vertical movement and biased downwardly against said ring seat, said annular ring being helically threaded along the internal surface thereof;

(c) a bowl assembly including an annular substantially vertical flange helically threaded along the external surface and meshing with the internally threaded surface of said annular ring, and an upper crusher surface secured to said flange;

(d) a head assembly including a lower crusher surface spaced an adjustable predetermined static distance from said upper crusher surface;

(e) bowl assembly adjusting means mounted on said ring for rotating said bowl assembly to adjust the static distance from said upper and lower surfaces;

(f) a stationary support shaft having a top portion, and also having a bottom portion rigidly maintained within the central bore of said hub;

(g) head assembly support means for vertically and horizontally supporting said head assembly on said shaft, and including an upper spherical bearing surface secured to said head assembly, and a lower spherical bearing surface secured to said support shaft top portion and supporting said upper bearing surface;

(h) an eccentric means mounted for rotational movement about said stationary shaft for imparting gyratory motion to said lower crusher surface, said eccentric means supported axially by said central hub;

(i) drive means for rotating said eccentric means; and (j) a plurality of release means each supported by said base and connected to said annular ring for biasing said annular ring against said ring seat under normal operating conditions and for permitting upward vertical displacement of said annular ring when said upper and lower crusher surfaces encounter tramp material, said release means additionally being operative to positively displace said annular ring upward under static conditions for clearing the space between said upper and lower crusher surfaces.

20. The apparatus of claim 19 in which the radial arms have an annular vertical flange which provides a weld seat for said annular shell.

21. The apparatus of claim 19 in which said release means comprises a plurality of double acting hydraulic cylinders and pistons secured between said adjusting ring and said paired vertical flanges, and an accumulator tank communicating with said cylinder, said pistons normally maintained in a first position by hydraulic fluid in said cylinder.

22. The apparatus of claim 21, further comprising a hydraulic pressure source for normally maintaining the hydraulic fluid within said cylinder under a predetermined pressure, said release means further including means responsive to momentary pressure levels above the predetermined level for moving the fluid into the accumulator tank thereby permitting said piston to be displaced by said adjusting ring lifting off of said ring seat and for returning said fluid when momentary pressure levels return to the predetermined level to return said adjusting ring to said ring seat.

23. The apparatus of claim 21 in which said release means further includes a fluidic system means responsive to a signal for displacing said piston to a second position in which said adjusting ring and said bowl assembly are displaced vertically upward.

24. The apparatus of claim 19 in which said ring seat has a wedge cross-section, the upper-outer surface of which provides an abutment for the normally downwardly biased adjustment ring.

25. The apparatus of claim 19 further including bearing surfaces located between said eccentric and stationary support shaft, between said head assembly and said eccentric, and between said hub and said eccentric, and lubrication passages extending through said shaft directly to said bearing surfaces between said eccentric and said head assembly, and between said eccentric and said shaft, and also directly to said upper and lower bearing surfaces.

26. The apparatus of claim 19 in which the bowl assembly adjusting means comprises double acting ram assembly including a hydraulic cylinder and an axially movable piston therein, said piston has connected to the outer end thereof a bowl engaging means for rotating said bowl selective distances both clockwise and counter-clockwise.

27. The apparatus of claim 26 in which the bowl assembly has an annular flange with spaced abutments extending along the outer surface thereof, said bowl engaging means being a forked extension capable of abutting either side of said abutments wherein a first position said forked extension is oriented such that an engaged abutment is pushed away from said ram assembly when said piston is extended in said cylinder in response to a first actuating signal and in a second position is oriented such that an engaged abutment is pulled toward said ram assembly when said piston is retracted in said cylinder in response to a second actuating signal.

* * * * *

REEXAMINATION CERTIFICATE (1199th)

United States Patent [19] [11] B1 4,478,373

Gieschen [45] Certificate Issued Jan. 30, 1990

[54] CONICAL CRUSHER

[75] Inventor: John A. Gieschen, West Allis, Wis.

[73] Assignee: Nordberg Inc.

Reexamination Request:
No. 90/001,781, Jun. 6, 1989

Reexamination Certificate for:

| | |
|---|---|
| Patent No.: | **4,478,373** |
| Issued: | **Oct. 23, 1984** |
| Appl. No.: | **196,509** |
| Filed: | **Oct. 14, 1980** |

[51] Int. Cl.[4] ..... B02C 2/04
[52] U.S. Cl. ..... 241/208; 241/285 R
[58] Field of Search ..... 241/207-216

[56] References Cited

U.S. PATENT DOCUMENTS 3,604,640 9/1971 Webster .
4,615,491 10/1986 Batch et al. .

FOREIGN PATENT DOCUMENTS 801091 9/1958 United Kingdom .

*Primary Examiner*—Timothy V. Eley
*Attorney, Agent, or Firm*—Welsh & Katz, Ltd.

[57] ABSTRACT

A crusher of the conical type has a spherical bearing arrangement for supporting the head assembly on a stationary shaft. Included are tramp release means for automatically opening the crusher throat when tramp material is encountered and for jacking open the throat under nonoperating conditions.

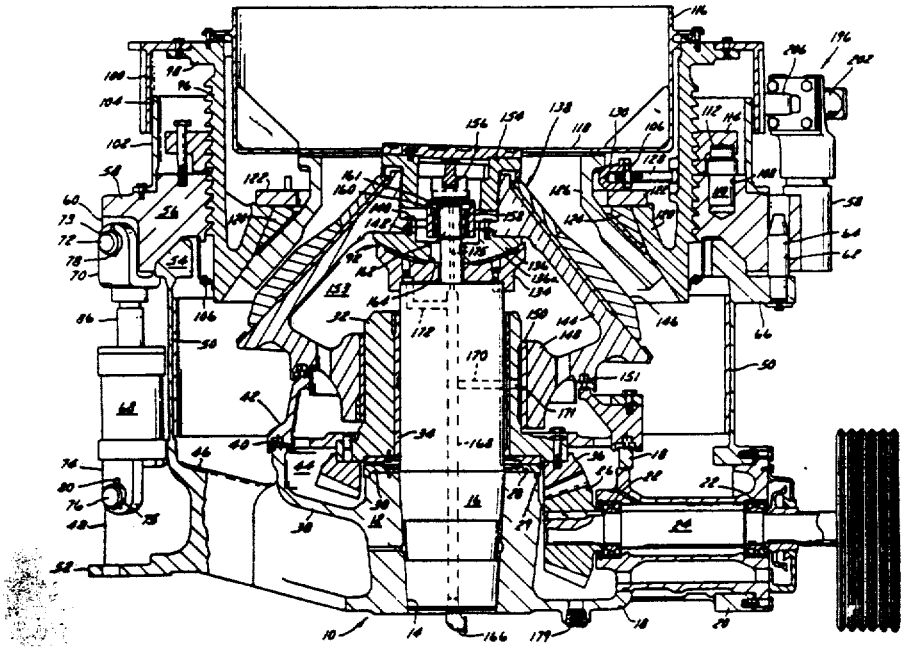

REEXAMINATION CERTIFICATE ISSUED UNDER 35 U.S.C. 307

THAT PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentablity of claims 8–27 is confirmed.

Claim 1 is determined to be patentable as amended.

Claims 2–7, dependent on an amended claim, are determined to be patentable.

1. An apparatus for crushing materials, comprising:

(a) a frame structure including a hub member having a vertical bore;

(b) a stationary support member having a central longitudinal axis, and having an upper portion and a lower portion, said lower portion being positioned within said bore and secured to said hub;

(c) a cylindrical eccentric mounted around said stationary support member for eccentric rotation therearound, said eccentric having an axis which intersects said longitudinal axis;

(d) means for rotating said eccentric about said support member;

(e) a head assembly having a cylindrical eccentric follower mounted on said eccentric for eccentric rotational movement about said support member, and including a lower crusher surface, and an upper spherical bearing member fixed to the underside of said head assembly;

(f) a bowl assembly mounted for adjustable movement relative to said frame, said bowl assembly having an upper crusher surface spaced an adjustable predetermined distance from said lower surface under static conditions; and (g) a spherical bearing seat supported by *and* rigidly fixed to said upper portion of said support member, and holding and supporting said upper spherical bearing member, said spherical bearing seat having a center of curvature which substantially coincides with said intersection of said eccentric axis and said longitudinal axis.

* * * * *